US005855339A

United States Patent [19]

Mead et al.

[11] Patent Number: 5,855,339

[45] Date of Patent: Jan. 5, 1999

[54] SYSTEM AND METHOD FOR SIMULTANEOUSLY GUIDING MULTIPLE MISSILES

[75] Inventors: Donald C. Mead, Carlsbad, Calif.; Carl G. Foster, Tucson, Ariz.

[73] Assignee: Raytheon Company, El Segundo, Calif.

[21] Appl. No.: 888,963

[22] Filed: Jul. 7, 1997

[51] Int. Cl.[6] ..... F41G 7/00

[52] U.S. Cl. ..... 244/3.11; 244/3.14

[58] Field of Search ..... 244/3.11, 3.14, 244/3.13, 3.15, 3.16, 3.19

[56] References Cited

U.S. PATENT DOCUMENTS

| | | | |
|---|---|---|---|
| 3,818,453 | 6/1974 | Schmidt et al. | 370/324 |
| 3,856,237 | 12/1974 | Torian et al. | 244/3.11 |
| 4,100,545 | 7/1978 | Tabourier | 244/3.14 |
| 4,738,411 | 4/1988 | Ahlstrom et al. | 244/3.15 |
| 4,997,144 | 3/1991 | Wolff et al. | 244/3.14 |
| 5,042,743 | 8/1991 | Carney | 244/3.11 |
| 5,101,417 | 3/1992 | Richley et al. | 370/479 |
| 5,379,966 | 1/1995 | Simeone et al. | 244/3.14 |
| 5,458,041 | 10/1995 | Sun et al. | 244/3.11 |

*Primary Examiner*—Charles T. Jordan
*Assistant Examiner*—Theresa M. Wesson
*Attorney, Agent, or Firm*—Brian C. Downs; Leonard A. Alkov; Glenn H. Lenzen, Jr.

[57] ABSTRACT

A system and method that covertly provides in-flight target update data to a large number of missiles. The system and method covertly guides the missiles using a transponder located on a satellite that relays encoded target update data to receivers located on each of the missiles. The target update data is derived from intelligence data acquired by a remote sensing device. The target update data is typically transmitted to the missile launch site where it is encoded and transmitted to the transponder on the satellite. The encoding is preferably accomplished using direct sequence spread spectrum/code division multiple access (CDMA) encoding produced using unique seeds that are supplied to pseudo random code generators that uniquely encode the data to be transmitted to each missile. The receivers on each of the missiles have pseudo random code generators that are loaded with the unique seeds. The present system and method enable rapid response to fast-changing battlefield environments, particularly where mobile or relocatable targets are involved.

14 Claims, 2 Drawing Sheets

SYSTEM AND METHOD FOR SIMULTANEOUSLY GUIDING MULTIPLE MISSILES

BACKGROUND

The present invention relates to a system and method for covertly providing a large number of missiles with updated guidance data during their flight, which system and method are particularly useful in targeting the missiles at mobile targets.

A new generation of missiles (and missile applications) is under development by the assignee of the present invention that are designed such that a salvo of many missiles is launched at many targets in a battlefield area. More specifically, a new missile variant known as a Tomahawk Stops The Attacking Regiments (TSTAR) missile is under development to counter the movement of armored columns and other mobile targets into a battlefield area.

The TSTAR missile contains multiple heat-seeking submunitions that are deployed in proximity of the targets. However, during a TSTAR mission, an armored column can move approximately 3 kilometers in five minutes, and can move over 44 kilometers while the TSTAR missiles are en route. Because the targets have the ability to constantly change their location and direction during the flight of the missiles, when the missiles arrive at the projected target area, the mobile targets may have moved so that the heat-seeking submunitions are not able to acquire their targets.

Furthermore, it is highly desirable that the salvo of missiles be relatively undetectable while in flight to the target area. This requires that guidance signals sent to the respective missiles must not be readily detected. The present invention has been developed to address these two basic problems.

Accordingly, it is an objective of the present invention to provide for a system and method that covertly provides more accurate, updated guidance data to a large number of missiles during their flight to allow them to be more accurately guided to their target locations. It is an objective of the present invention to provide for a system and method that covertly guides a large number of missiles, with each individual missile receiving only information that is necessary for it.

SUMMARY OF THE INVENTION

To meet the above and other objectives, the present invention provides for a system and method that covertly transmits updated guidance data to a large number of missiles during flight that more accurately guide them to their respective target locations. The present system and method covertly guides all of the missiles using a single transponder located on a satellite that relays the updated guidance data to receivers located on each of the missiles. Tomahawk TSTAR missiles may be preferably employed as the missiles used in the present system. The updated guidance data is derived from intelligence data acquired by a remote sensing device. The constantly changing location and direction of mobile targets is monitored using a sensor on the remote sensing device and transmitted for processing using a transmitter.

The intelligence data acquired by the remote sensing device is typically transmitted to a missile launch site, such as a ship in the case of the TSTAR missiles, where it is processed to generate the updated guidance data, encoded for transmission, and transmitted by a transmitter to the transponder on the satellite which relays the data to receivers on the missiles. The encoding is preferably accomplished using direct sequence spread spectrum/code division multiple access (CDMA) encoding produced using unique seeds that are supplied to pseudo random code generators that uniquely encode the data for each missile prior to transmission. The receivers on each of the missiles have pseudo random code generators that are loaded with the unique seeds that identify the respective missile, and which uniquely decode the updated guidance data received by that missile.

The direct sequence spread spectrum CDMA modulated updated guidance data that is transmitted to each of the missiles is observable by an enemy as an imperceptible rise in transponder noise power. Furthermore, each missile has a different pseudo random code generator seed that causes each of the missiles to appear as white noise to the other missiles. The spread spectrum sequencing adds transmission security. Without a prior knowledge of the transmission security keys and algorithms, an adversary cannot intercept or spoof the en route missiles.

The satellite may be a satellite of a Global Broadcast System (GBS), for example. The Global Broadcast System is similar to the currently deployed Direct Broadcast Satellite (DBS) system developed by the assignee of the present invention. The Global Broadcast System uses substantially the same modulation waveform as the DBS system, but each satellite provides multiple movable spot beams. The satellites of the Global Broadcast System utilize a transponder frequency in the Ka band. However, the transponder operates in substantially the same manner as transponders used in the DBS system.

In operation, the missiles are launched with target location data that guide them to the projected target location at the missiles' time of arrival. Up-to-date intelligence data derived from the remote sensing device is processed to generate the updated guidance data which are sent to the missiles in the form of in-flight target updates (IFTUs) as they approach their respective target locations. The bandwidth of the transponder used in the Global Broadcast System supports transmission of in-flight target updates to on the order of 200 en route missiles. The present system and method enables rapid response to fast-changing battlefield environments, particularly where mobile or relocatable targets are involved.

More specifically, the system and method of the invention operate as follows. Mobile targets are detected and monitored by a remote sensing device, which may comprise a sensor and transmitter disposed on an unmanned aerial vehicle, for example. Intelligence data comprising current target location data indicative of the current location of the targets sensed by the sensor is transmitted from the remote sensing device to a missile launch site, for example. A large number or salvo of missiles that each have a receiver embodying a pseudo random code generator are loaded with unique seeds is launched toward the mobile targets.

The current target location data is processed by a gunner, for example, to produce target update data. The target update data for each missile is encoded using spread spectrum CDMA coding in conjunction with the unique seed for each missile, which produces encoded in-flight target updates for each missile. The encoded in-flight target update data are transmitted to the transponder in the satellite which retransmits it for reception by the missiles. The particular missile for which the data is intended decodes the encoded in-flight target update data using the unique seed in its pseudo random code generator. Each missile is retargeted in accordance with its own target update enabling them to more precisely locate the mobile targets.

Use of the present system permits a large number of missiles (well over 50) to be guided using the single satellite transponder. An uninformed observer is only able to detect that the apparent white noise level output of the transponder has risen, which makes the present invention relatively undetectable and covert.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
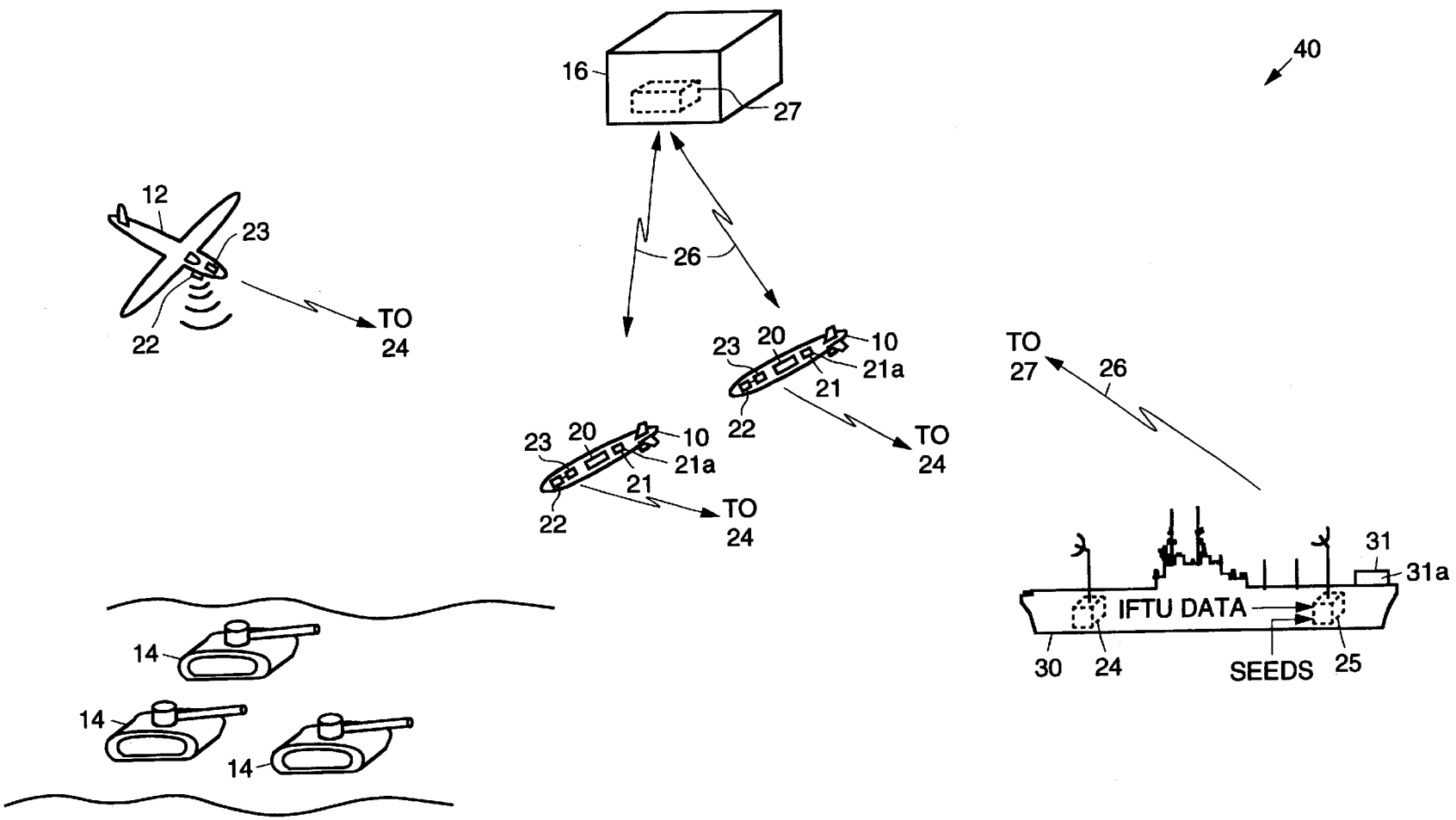
FIG. 1 shows a system in accordance with the principles of the present invention that covertly and simultaneously provides updated guidance data to a large number of missiles during flight.

Referring to the drawing figures, FIG. 1 shows a system 40 in accordance with the principles of the present invention that covertly and simultaneously provides updated guidance data to a large number of missiles 10, typically on the order of from fifty to hundreds missiles 10 that are launched in a salvo. A Tomahawk TSTAR cruise missile 10 may be advantageously employed as the missile 10 used in the present system 40. The TSTAR missile 10 is designed to counter the movement of armored columns and other relocatable or mobile targets 14 moving into a battlefield. Each of the missiles 10 contains a plurality of heat-seeking submunitions 20 that are deployed once the missiles 10 reach the vicinity of the mobile targets 14. The heat-seeking submunitions 20 seek out and ultimately destroy acquired mobile targets 14.

Each missile 10 is launched from a missile launcher 31 located on a ship 30 or other suitable launch vehicle or position 30 under control of one or more gunners. Prior to launch of the missiles 10, a unique seed is loaded into a pseudo random code generator 21*a* that is part of a receiver 21 located in each missile 10 and into a corresponding pseudo random code generator 31*a* in the respective launcher 31. Thus, for each missile 10, there is a unique seed that identifies it and which is used in the present invention to covertly transmit data to each respective missile 10.

The system 40 comprises a battlefield monitoring device 12, such as an unmanned aerial vehicle 12, a satellite 16, or a manned aerial vehicle, for example containing a sensor 22 and a transmitter 23. The sensor 22 may be a video camera, while the transmitter 23 may comprise a conventional satellite communication transmitter, for example. In a preferred alternative, the battlefield monitoring device 12 may be a sensor 22 located in each of the missiles 10. Any of the embodiments of the battlefield monitoring device 12 is used to obtain intelligence data indicative of the current location of the mobile targets 14 during the respective flights of each of the missiles 10. In any case, the sensor 22 in the battlefield monitoring device 12 or missile 10 relays the current target location data to the gunner using the transmitter 23 and a receiver 24 located onboard the ship 30 or at the launch position 30.

The gunner processes the current target location data received from the sensors 21 and generates updated target location data 26 (comprising guidance control signals for the respective missiles 10) in the form of in-flight target updates (IFTUs) 26. The in-flight target updates 26 are encoded (modulated) using direct sequence spread spectrum/code division multiple access (CDMA) coding. While frequency separation or time separation may also be used, these coding techniques do not have the advantages of CDMA coding.

The direct sequence spread spectrum CDMA modulation is generated by an exclusive-OR of a serial data stream (the updated target location data 26 for the most recent position of the mobile targets 14 to which each missile 10 is responsible) and the output of a pseudo random code generator 31*a* used in conjunction with a transmitter 25, which produces a chip stream. The pseudo random code generator 21*a* in the receivers 21 and those associated with the launcher 31 and transmitter 25 are synchronized prior to launch. By selecting an appropriate chip rate, the updated target location data 26 comprising the in-flight target updates 26 is spread over the bandwidth of the transmitter 25 that is used to transmit the in-flight target updates 26 to the missiles 10. The observable signal that is detectable by an observer is an imperceptible rise in the transmitted noise power of the signal.

To guide the salvo of missiles 10, each missile 10 has a different seed loaded in its pseudo random code generator 21*a* which causes each of the missiles 10 to appear as white noise to all of the other missiles 10. The spread spectrum sequencing adds transmission security. Without a prior knowledge of transmission security keys and coding algorithms, an observer cannot intercept or spoof the en route missiles 10.

In a preferred embodiment of the present invention, the in-flight target updates 26 are transmitted by way of the transmitter 25 to a transponder 27 disposed on a satellite 16. The transponder 27 acts as a repeater that receives and retransmits the in-flight target updates 26 to the receivers 21 located the missiles 10. While each receiver 21 receives the transmitted in-flight target updates 26, the receiver 21 having the correct seed stored in its pseudo random code generator 21*a* is the only receiver 21 that is able to decode the specific in-flight target updates 26 that are sent to it.

The satellite 16 employed to relay the in-flight target updates 26 to the missiles 10 in real time may be part of a Global Broadcast System (GBS) or similar satellite system. The Global Broadcast System is similar to the currently deployed Direct Broadcast Satellite system developed by the assignee of the present invention. The Global Broadcast System uses the same modulation waveform as the Direct Broadcast Satellite system, but has multiple movable spot beams per satellite that create a high Effective Isotropic Radiated Power (EIRP). The GBS satellites 16 utilize frequencies in the Ka band that are different from Direct Broadcast Satellite system, but the two systems operate in substantially the same manner.

A key advantage of using the satellite 16 to relay the in-flight target updates 26 to the missiles 10 is that it has a fixed and known location relative to the ship 30 or launch position 30. Consequently, the additional complexity required to transmit the in-flight target updates 26 to an intermediate moving vehicle, such as the unmanned aerial vehicle 12 or manned vehicle, for example, need not be addressed. However, notwithstanding this, it is to be understood that the present invention may also use moving vehicles or other intermediate types of apparatus to relay the in-flight target updates 26 to the missiles 10, although additional complexity is involved.

Figure 2:
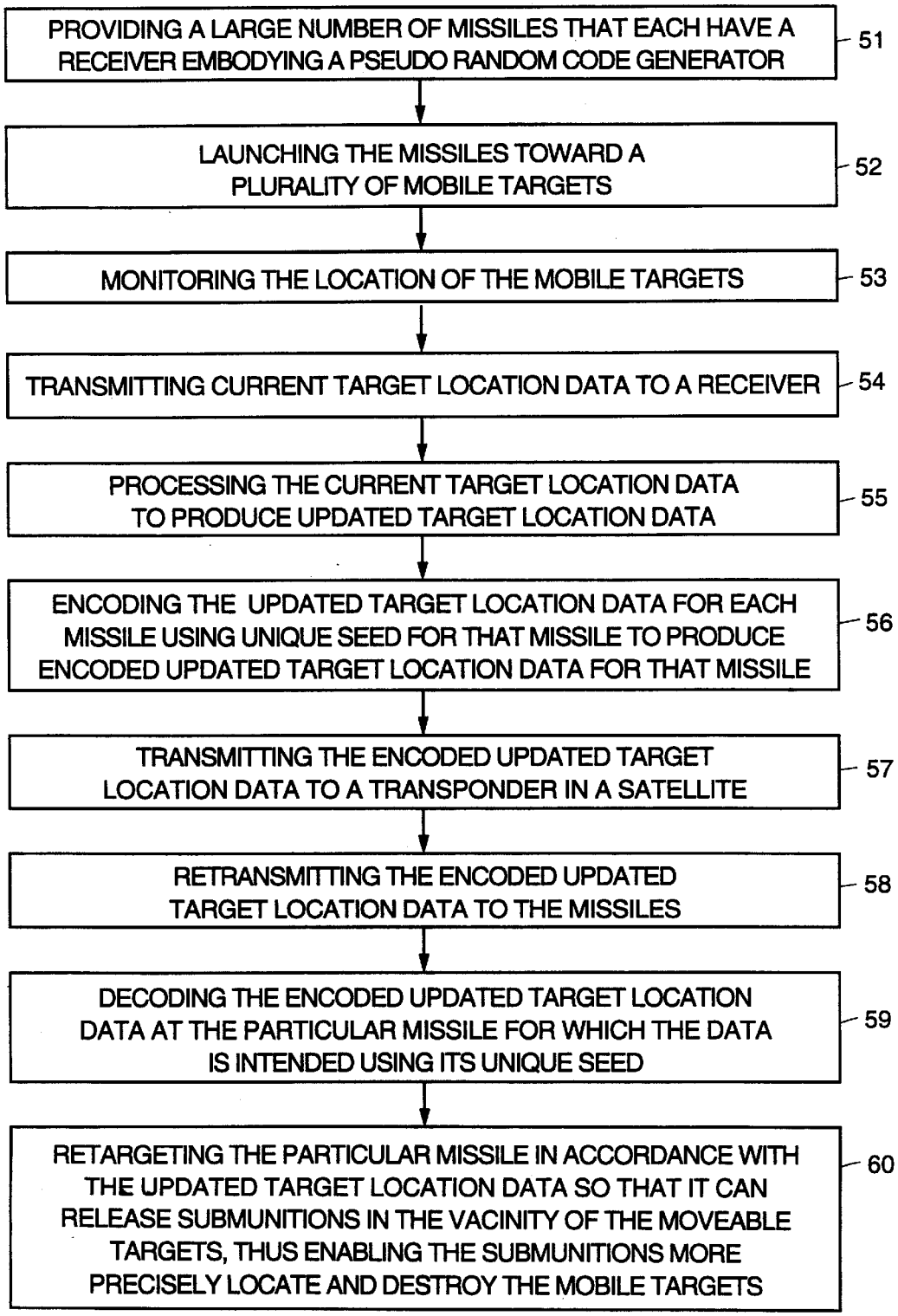
FIG. 2 is a flow diagram illustrating a preferred method in accordance with the principles of the present invention.

Referring now to FIG. 2, it is a flow diagram illustrating one method 50 in accordance with the principles of the present invention. In general, the present system 40 operates in accordance with the method 50 as follows. A large number or salvo of missiles 10 that each have a receiver 21 embodying a pseudo random code generator 21*a* are programmed or loaded 51 with unique seeds. The salvo of missiles 10 is launched 52 toward a plurality of mobile targets 14. The mobile targets 14 are detected and monitored 53 by sensors 22 onboard a battlefield monitoring device 12, such as by sensors 22 onboard an unmanned aerial vehicle 12. The current target location data is transmitted 54 to a receiver 24 onboard a ship 30 or at a launch position 30.

The current target location data is processed 55 by a gunner or controller to produce target update data. The target update data for each missile 10 is encoded 56 using spread spectrum CDMA coding and the unique seed for that missile 10, which produces an encoded in-flight target update 26 for that missile 10. The encoded in-flight target update 26 is then transmitted 57 to a transponder 27 on a satellite 16 which retransmits 58 the encoded in-flight target update 26 to the missiles 10. The particular missile 10 for which the data 26 is intended decodes 59 the encoded in-flight target update data 26 using the unique seed in its pseudo random code generator 21*a*. That particular missile 10 is retargeted 60 in accordance with the in-flight target update data 26 to the vicinity of the moveable targets 14.

The present system 40 and method 50 thus permits a large number of missiles 10 (well over 50) to be guided by way of the transponder 27 located in the satellite 16 to attack a large number of mobile targets 14. The present invention is also covert, in that an uninformed observer is only able to detect that the apparent white noise level output of the transponder 27 has risen.

To be effective, a group of en route missiles 10, for example, must be downloaded with in-flight target updates 26 within about one minute. The allocated update duration is chosen to maximize tactical flexibility and allow the missiles 10 to attack moving targets 14 using real-time intelligence data. A 50-waypoint message has a size of approximately 12.8 Kbits. Given a time to transmit of one minute, the required bit rate per missile 10 is 213 bits per second (bps). The required data rate is assumed to be about 250 bits per second, to account for embedded formatting data. The updated target location data is simultaneously transmitted to each of the missiles 10 with each missile 10 processing only its respective update information using its unique seed. The pseudo random code generators can operate at a minimum of 20 Mbps. Since the guidance requirements for each missile 10 are about 2,000 bits per second, the coding gain is about 10,000.

The transponder 27 of the Global Broadcast System satellite 16 has a bandwidth of about 36 MHz which supports a spread spectrum chip rate of 23.5 Mbps, or 2.35 Mbps per missile 10. Thus, for each missile 10, the required data rate is 250 bits per second. The coding gain is given by chip rate/bit rate=$2.35\times10^6/250=9.4\times10^3$=40 dB. This 40 dB processing gain enables unsteered conformal antennas (not shown) on the surfaces of respective missiles 10 to receive the signals transmitted by the transponder 27. In a typical DBS satellite system, for example, the antenna gain is 40 dB, based on a 0.5 meter diameter parabolic antenna at 30 GHz and 50% efficiency. The available gain of a non-steerable missile receive antenna is 0 dBic, or +3 dBil. Adding the processing gain to the antenna gain yields a total antenna and processing gain of about 37 dB is available at the missile 10. This gain is sufficient to provide an effective throughput of 250 bps per missile 10 for a TSTAR missile 10. Data compression techniques may be used to regain the 3 dB by reducing the required bit rate by a factor of two. Thus, the receiver 21 in the missile 10 coupled to a hemispherical missile antenna has approximately the same link margin as a consumer-grade digital satellite receiver.

A single 23.5 Mbps transponder 27 disposed on a satellite 16 of the Global Broadcast System may be used to guide multiple missiles 10 as described above on an as-needed basis. This is achieved by having multiple transponder configurations. For normal operation, the transponder 27 may be configured to provide five T1 channels (7.5 Mbps) and four TV channels (at 4 Mbps each), for example. In the case of a missile guidance application, the same 23.5 Mbps capacity may be dynamically reallocated. For example, three TV channels may be replaced by eight additional T1 channels to support missile guidance.

The Global Broadcast System-based data link employed in the present invention communicates secure updated guidance data to a large number of missiles 10. Using the present invention, the missile 10 only requires a GBS-compatible receiver 21 and antenna. The receiver 21 is relatively small and does not require cooling. The receiver 21 may be mounted in a limited volume that remains when submunition dispensers are added to a Tomahawk missile 10, for example. The GBS operating frequency allows the missile antenna to be small enough to fit in a relatively narrow strip on the top of the missile 10 between covers of the submunition dispenser.

Thus, a system and method that covertly provides a large number of missiles with in-flight target update information have been disclosed. It is to be understood that the described embodiment is merely illustrative of some of the many specific embodiments which represent applications of the principles of the present invention. Clearly, numerous and varied other arrangements may be readily devised by those skilled in the art without departing from the scope of the invention.

What is claimed is:

1. A system for covertly providing a large number of missiles with in-flight updated guidance data improve the ability of the missiles to attack multiple mobile targets, said system comprising:

a plurality of missiles that each comprise a receiver having a pseudo random code generator that contains a unique seed;

a monitoring device having a sensor for generating current target location data indicative of current locations of the multiple mobile targets, and having a transmitter for transmitting the current target location data;

a receiver located at a missile control location for receiving the current target location data;

transmitter means having a pseudo random code generator that contains a plurality of unique seeds that correspond to each of the plurality of missiles, for processing the current target location data to generate uniquely encoded in-flight target updates, and for transmitting the encoded in-flight target updates; and a satellite comprising a transponder for receiving the transmitted encoded in-flight target updates and for relaying the target updates to the plurality of missiles;

and wherein the respective receivers in the plurality of missiles each process the relayed encoded in-flight target updates and decode those target updates that were encoded using the corresponding unique seed, and wherein the decoded target updates more accurately guide the missiles to their respective target locations.

2. The system of claim 1 wherein the monitoring device comprises an unmanned aerial vehicle.

3. The system of claim 1 wherein the monitoring device comprises a manned aerial vehicle.

4. The system of claim 1 wherein the monitoring device comprises a satellite-based remote sensing device.

5. The system of claim 1 wherein the monitoring device comprises the missile.

6. The system of claim 1 wherein the satellite comprises a Global Broadcast System satellite.

7. The system of claim 1 wherein the sensor comprises a video camera.

8. The system of claim 1 wherein the encoded in-flight target updates that are transmitted to each missile are modulated using direct sequence spread spectrum CDMA modulation generated by an exclusive-OR of the target update data and the output of the pseudo random code generator derived from the unique seed for each missile.

9. A method for covertly providing a plurality of missiles with updated guidance data during their respective flights to improve the ability of the missiles to attack multiple targets, said method comprising the steps of:

providing a plurality of missiles that each has a receiver embodying a pseudo random code generator having a unique seed;

launching a salvo of missiles toward the multiple mobile targets;

monitoring the mobile targets using sensors onboard a monitoring device;

transmitting current target location data from the monitoring device to a receiver;

processing received current target location data to produce target update data for each missile;

encoding the target update data for each missile using a spread spectrum CDMA coding technique and the unique seed for the missile which produces an encoded in-flight target update for each missile;

transmitting the encoded in-flight target update to a transponder on a satellite;

retransmitting the encoded in-flight target update from the transponder to the plurality of missiles;

decoding the encoded in-flight target update data at each missile for which the data is intended in the receiver by demodulating the encoded data encoded using the unique seed associated with the missile by using the unique seed in its pseudo random code generator; and retargeting the particular missile in accordance with the in-flight target update data to the vicinity of the mobile targets.

10. The method of claim 9 wherein the step of monitoring the mobile targets comprises the step of monitoring the mobile targets using an unmanned aerial vehicle.

11. The method of claim 9 wherein the step of monitoring the mobile targets comprises the step of monitoring the mobile targets using a manned aerial vehicle.

12. The method of claim 9 wherein the step of monitoring the mobile targets comprises the step of monitoring the mobile targets using a satellite-based remote sensing device.

13. The method of claim 9 wherein the step of monitoring the mobile targets comprises the step of monitoring the mobile targets using a sensor disposed on the missile.

14. The method of claim 9 wherein the step of encoding the target update data comprises modulating the target update data using direct sequence spread spectrum CDMA modulation generated by an exclusive-OR of the target update data and the output of the pseudo random code generator derived from the unique seed for each missile.

* * * * *